US008105039B1

(12) United States Patent
El-Aini et al.

(10) Patent No.: US 8,105,039 B1
(45) Date of Patent: Jan. 31, 2012

(54) AIRFOIL TIP SHROUD DAMPER

(75) Inventors: Yehia M. El-Aini, Jupiter, FL (US); Stuart K. Montgomery, Jupiter, FL (US)

(73) Assignee: United Technologies Corp., Hartford, CT (US)

( * ) Notice: Subject to any disclaimer, the term of this patent is extended or adjusted under 35 U.S.C. 154(b) by 0 days.

(21) Appl. No.: 13/078,567

(22) Filed: Apr. 1, 2011

(51) Int. Cl.
*F01D 5/26* (2006.01)

(52) U.S. Cl. ..... 416/195; 416/196 R; 416/500

(58) Field of Classification Search ..... 416/189, 416/195, 196 R, 500
See application file for complete search history.

(56) References Cited

U.S. PATENT DOCUMENTS

| | | | | |
|---|---|---|---|---|
| 2,942,843 | A * | 6/1960 | Sampson | 416/190 |
| 3,728,044 | A * | 4/1973 | Fujita et al. | 416/190 |
| 3,752,599 | A * | 8/1973 | Pace | 416/190 |
| 4,025,232 | A * | 5/1977 | Imai et al. | 416/191 |
| 4,028,006 | A * | 6/1977 | Kuroda et al. | 416/191 |
| 4,401,411 | A * | 8/1983 | Hisano et al. | 416/196 R |
| 5,165,860 | A | 11/1992 | Stoner et al. | |
| 5,232,344 | A | 8/1993 | El-Aini | |
| 5,498,137 | A | 3/1996 | El-Aini et al. | |
| 5,558,497 | A | 9/1996 | Kraft et al. | |
| 5,820,343 | A | 10/1998 | Kraft et al. | |
| 6,055,805 | A | 5/2000 | El-Aini et al. | |
| 6,125,626 | A | 10/2000 | El-Aini et al. | |
| 7,806,410 | B2 | 10/2010 | El-Aini et al. | |

OTHER PUBLICATIONS

Seleski, "Gas Turbine Efficiency Improvements Through Shroud Modifications", The Proven Alternative, Power Systems MFG., LLC, Jupiter, FL, 2011, www.powermfg.com.

Kaneko et al., "Analysis of Vibratory Stress of Integral Shroud Blade for Mechanical Drive Steam Turbine", Proceedings of the 36th Turbomachinery Symposium, pp. 69-77, 2007.

* cited by examiner

*Primary Examiner* — Ninh H Nguyen
(74) *Attorney, Agent, or Firm* — O'Shea Getz P.C.

(57) ABSTRACT

A turbine disk includes a rotor and a plurality of turbine blades, each comprising a root at a proximal end secured to the rotor and a tip having a shroud at a distal end. The shroud includes a inner diameter surface, an outer diameter surface and a segmented sidewall surface separating the inner and outer diameter surfaces. The shrouds of adjacent turbine blades are separated by a tip shroud damper, and which includes a retention rail that cooperates with the outer diameter surface to maintain a positional relationship of the damper, a inner flange that engages the segmented sidewall surface, and a web that separates the retention rail and the inner flange. The tip shroud damper reduces the vibratory responses of modes involving axial and radial shroud motion to prevent high cycle fatigue (HCT).

23 Claims, 6 Drawing Sheets

AIRFOIL TIP SHROUD DAMPER

BACKGROUND

1. Technical Field

The present invention relates to the field of turbine blades, and, in particular to shrouded turbine blades separated by a shroud damper.

2. Background Information

Turbine sections within axial flow turbine engines or turbo pumps (e.g., fuel or oxygen) include a rotor assembly comprising a rotating disk and a plurality of rotor blades circumferentially disposed around the disk. Each rotor blade includes a root, an airfoil, and a platform positioned in a transition area between the root and the airfoil. The roots of the blades are received in complementary shaped recesses within the disk. The platforms of the blades extend laterally outward and collectively form a flow path for fluid passing through the rotor stage.

In addition to a root, an airfoil and a platform, the blade may also include an integral tip shroud. The tip shroud generally seals a leakage path at the outer diameter, provides stiffness for the tip section to allow tuning against critical vibratory modes and provides damping at the contact interface of adjacent shroud surfaces. Contact forces required to achieve damping are generally developed due to blade untwist under centrifugal forces. However, in the case of high energy turbopumps, the airfoils are relatively short (e.g., about 2 inches/5.1 cm) and have negligible twist along the span thus preventing the airfoil from developing the conventional contact forces along the shrouds. In addition, the negligible twist prevents the shroud from sealing the leakage path.

There is a need for a damper and/or sealing structure between adjacent turbine tip shrouds.

DETAILED DESCRIPTION

Figure 1:
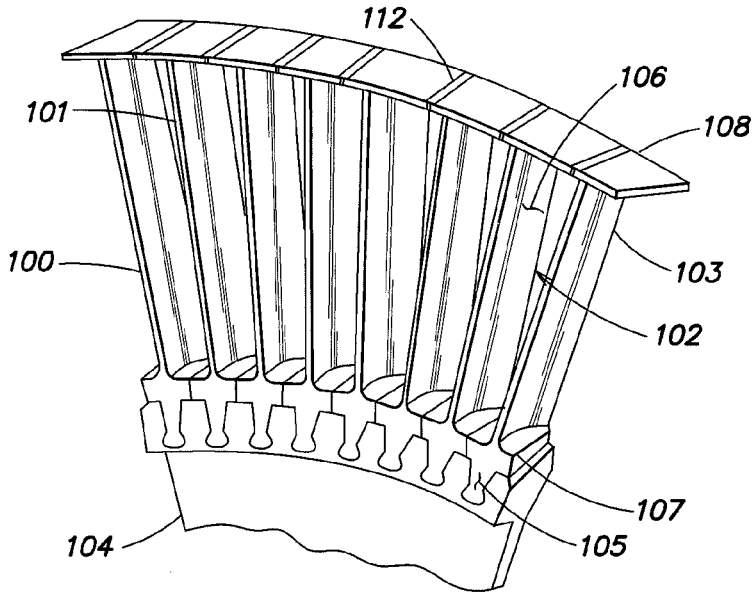
FIG. 1 is a perspective view of a plurality of turbine blades each having a tip shroud and attached to a disk.

FIG. 1 is a perspective view of a plurality of turbine blades, for example 100-103, each attached to a disk 104. Each turbine blade 100-103 includes a root 105, an airfoil 106, a platform 107 separating the root and the airfoil, and a tip shroud 108. In a gas turbine engine the airfoil may have a length about 5-10 inches/12.7-15.4 cm, whereas in a turbo pump application (e.g., fuel or oxygen) the airfoil may have a length of about 2 inches/5.1 cm. Each root is secured at its proximal end to a rotor.

Figure 2:
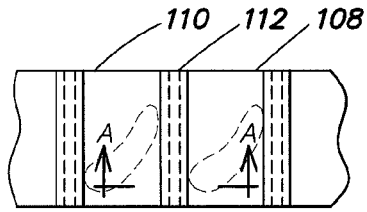
FIG. 2 is a top view of adjacent shrouded turbine blades separated by a tip shroud damper.

FIG. 2 is a top view of adjacent tip shrouds 108, 110 separated by a tip shroud damper 112. Each pair of adjacent shrouded turbine blades around the disk will be separated at their adjacent shrouds by an associated tip shroud damper (only tip shroud 112 is shown in the interest of ease of illustration).

Figure 3:
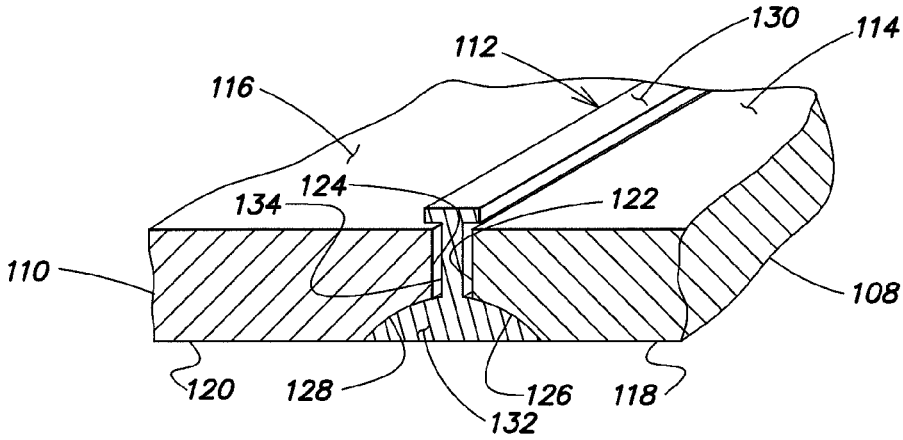
FIG. 3 is a cross sectional illustration taken along line A-A in FIG. 2 of a first embodiment of a tip shroud damper separating adjacent turbine blades.

FIG. 3 is a cross sectional illustration taken along line A-A in FIG. 2. Each shroud 108, 110 includes a respective outer diameter surface 114, 116, an inner diameter surface 118, 120 and a segmented sidewall surface separating the inner and outer diameter surfaces. The segmented sidewall surfaces include a first segment 122, 124 substantially perpendicular to the outer diameter surface 114, 116 and extending from the outer diameter surface, and a curved second segment 126, 128 extending from the associated first segment 122, 124 towards the associated inner diameter surface 118, 120. The tip shroud damper 112 includes a retention rail 130 that cooperates with the outer diameter surfaces 114, 116 to maintain proper radial positional relationship of the damper, an inner flange 132 that engages the curved segments 126, 128, and a web 134 that separates the retention rail 130 and the inner flange 132. The damper 112 may be a stiff metal alloy with the ability to react loads. Typical alloys include INCONEL® alloys (e.g., IN100, IN718, IN625, etc) and stainless steels (e.g., SS347, SS321, SS304, etc). Selection of the material will be based on the operating environment.

Figure 4:
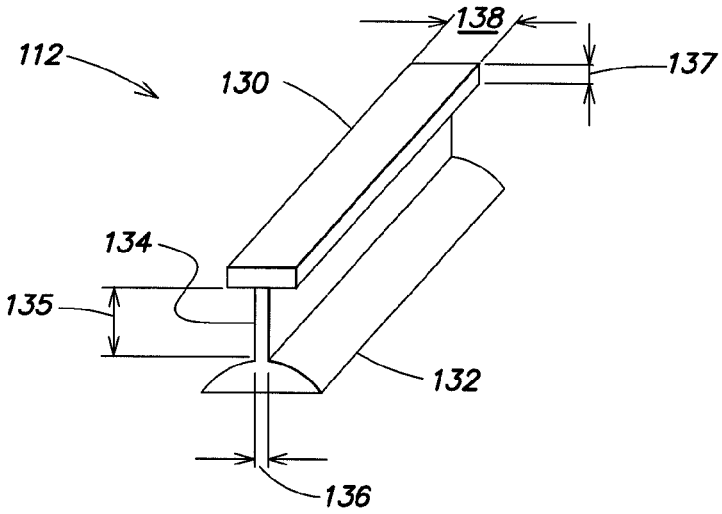
FIG. 4 is a perspective view of the tip shroud damper illustrated in FIG. 3.

FIG. 4 is a perspective view of the tip shroud damper 112 illustrated in FIG. 3. The web 134 may have a length L1 135 of about 0.08 inches and a width W1 136 of about 0.03 inches/0.08 cm, while the retention rail 130 may have a length L2 137 of about 0.02 inches/0.06 cm and a width W2 138 of about 0.1 inches/0.25 cm. The inner flange 132 may have a length L3 of about 0.02 inches/0.06 cm and a width W3 of about 0.17 inches/0.43 cm. In addition, edges of the shroud adjacent to the blade, and edges of the blade adjacent to the shroud may have a slight radius to reduce sharp adjacent corners.

The radial and axial gaps (e.g., about 0.04 inches/0.10 cm.) between the damper 112 and the shrouds 108, 110 are sufficient to prevent the damper from contacting the shrouds along the outer diameter surfaces 114, 116 (FIG. 3) during vibration. In addition, the damper weight (e.g., 0.39 grams) is sufficient to ensure it can slip under typical vibratory amplitudes.

Figure 5:
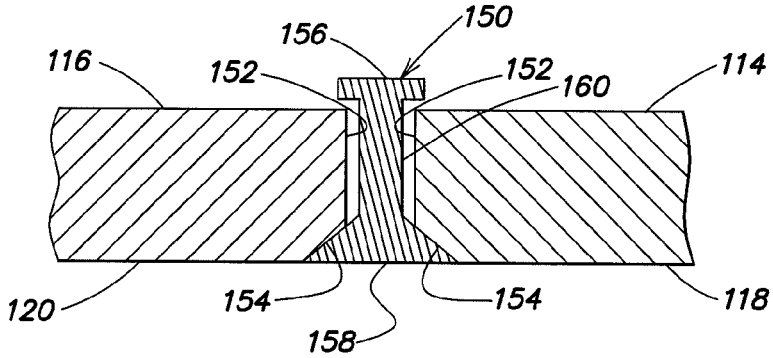
FIG. 5 is a cross sectional illustration also taken along line A-A in FIG. 2 of a second embodiment of a tip shroud damper separating adjacent turbine blades.

FIG. 5 is a cross sectional illustration of a second embodiment of a tip shroud damper 150 separating adjacent turbine blades. In this embodiment the segmented sidewall includes a first segment 152 substantially perpendicular to the outer diameter surfaces 114, 116 and extending from the outer diameter surfaces, and a second straight segment 154 extending from the first segment 152 towards the inner diameter surfaces 118, 120. The tip shroud damper 150 in this embodiment includes a retention rail 156, a inner flange 158 having surfaces face-to-face with the second segment 154 of the shroud, and a web 160 that separates the retention rail 156 and the inner flange 158.

Figure 6:
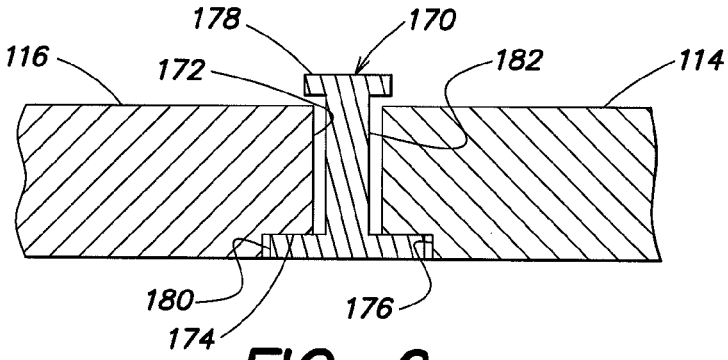
FIG. 6 is a cross sectional illustration taken along line A-A in FIG. 2 of a third embodiment of a tip shroud damper separating adjacent turbine blades.

FIG. 6 is a cross sectional illustration of a third embodiment of a tip shroud damper 170 separating adjacent turbine blades. In this embodiment the segmented sidewall includes a first straight segment 172 substantially perpendicular to the outer diameter surfaces 114, 116, a second straight segment 174, and a third straight segment 176. The first and third straight segments 172, 176 are substantially parallel, and both perpendicular to the second straight segment 174. The tip shroud damper 170 includes a retention rail 178, inner flange 180, and a web 182 between the retention rail 178 and the inner flange 180.

Figure 7:
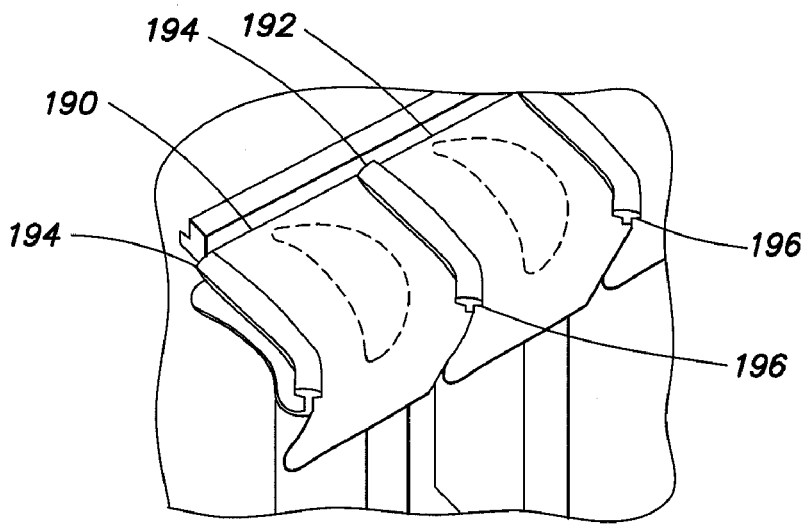
FIG. 7 is a perspective view of adjacent shrouded turbine blades separated by a tip shroud damper.

Referring again to FIG. 2, the shroud 112 extends substantially the entire axial depth (i.e., generally in the direction between leading and trailing edges of the blade) along the outer diameter surfaces 114, 116. However, in an alternative embodiment the damper may not extend the entire axial depth. For example, FIG. 7 is a perspective view of adjacent shrouded turbine blades 190, 192 separated by a tip shroud damper 194. In this embodiment the damper 194 extends only about 60-80% of the axial circumferential distance of the facing shroud outer diameter surfaces. The shrouds may have stepped edges 196 (e.g., cut to a depth of about 0.03 inches/0.1 cm) within which the retention rail may seat.

Figure 8:
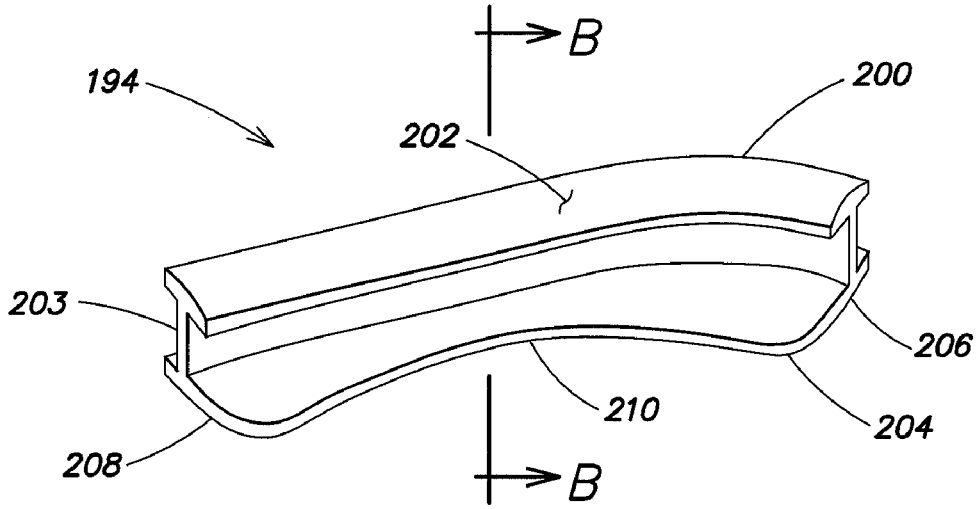
FIG. 8 is a perspective view of the tip shroud damper illustrated in FIG. 7.
Figure 9:
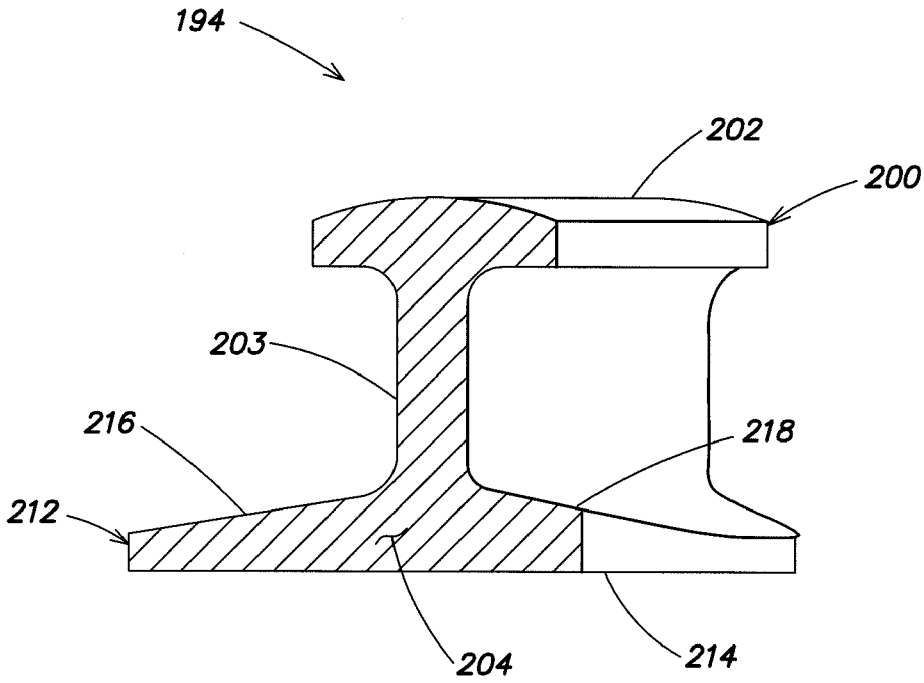
FIG. 9 is a cross sectional illustration taken along line B-B in FIG. 8, shown somewhat in perspective.

FIG. 8 is a perspective view of the tip shroud damper 194 illustrated in FIG. 7. The damper includes a retention rail 200 having a domed top surface 202, a web 203 and an inner flange 204 whose width is generally greater at ends 206, 208 in comparison to a central region 210. FIG. 9 is a cross sectional illustration taken along line B-B in FIG. 8, shown somewhat in perspective. First and second wings 212, 214 of the inner flange 204 have surfaces 216, 218 that extend from the web 203 at an angle less than or greater than 90 degrees.

Figure 10:
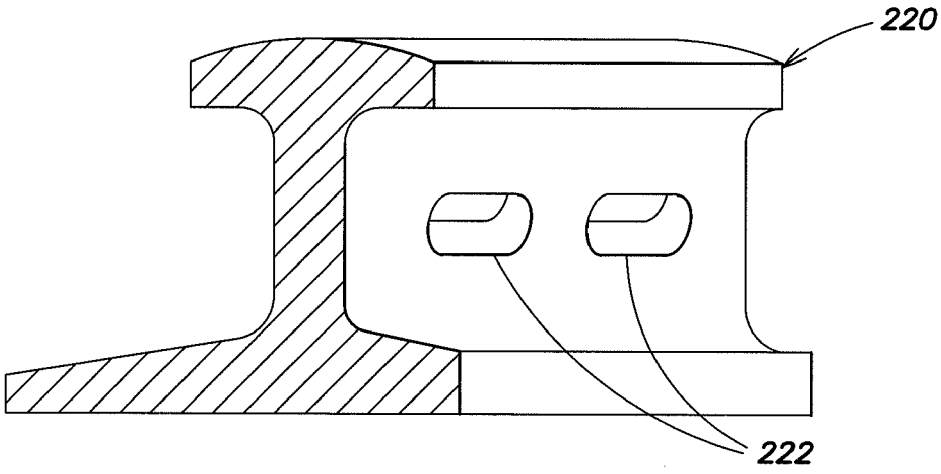
FIG. 10 is a perspective view of yet another tip shroud damper.

FIG. 10 is a perspective view of yet another tip shroud damper 220. This damper may be substantially similar to the tip shroud damper illustrated in FIG. 9, with the principal exception that the damper illustrated in FIG. 10 includes axial through holes 222 for weight reduction. It is contemplated that weight reduction of the damper may be achieved using, for example, circumferential holes, radial holes and/or hollow sections.

Figure 11:
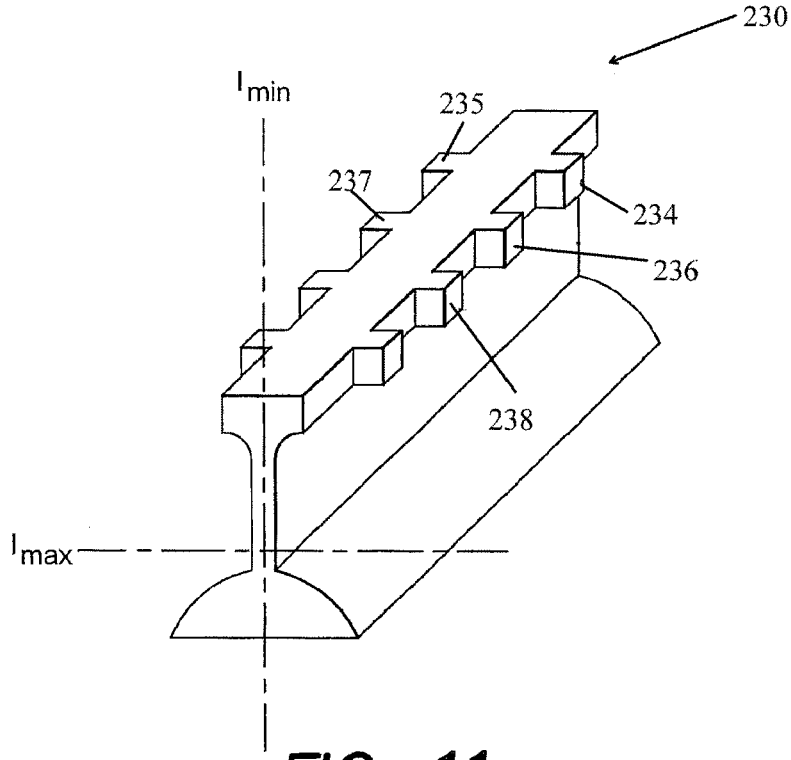
FIG. 11 is a perspective view of another tip shroud damper.

FIG. 11 is a perspective view of another tip shroud damper 230. This damper may be substantially similar to the tip shroud damper 112 illustrated in FIG. 4, with the principal exception that the damper illustrated in FIG. 11 includes a scalloped retention rail 232 comprising a plurality of fingers e.g., 234-238 extending from the retention rail. The scalloping may be used in order to obtain an optimum weight for the damper 230, since for example a heavy damper may lock in place at high RPMs and become ineffective. In addition, a general requirement for the damper is for a relatively high stiffness to weight ratio. Scalloping the retention rail 232 reduces the $I_{max}$ of the cross section. The damper design is a compromise between the desired high stiffness and light weight of the damper so it will not lock up.

Figure 12:
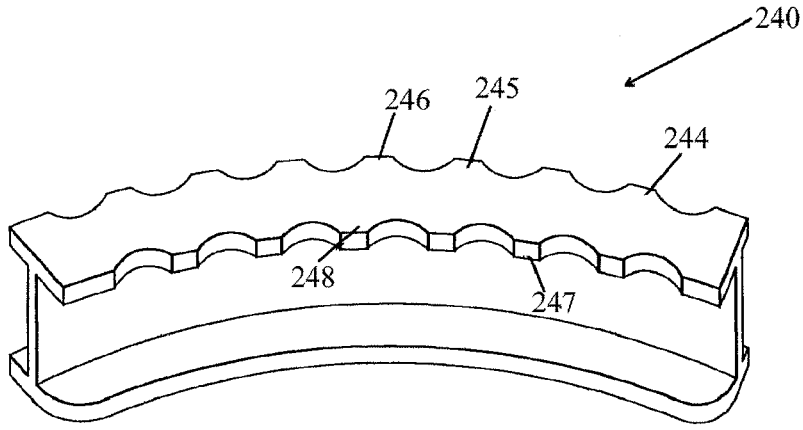
FIG. 12 is a perspective view of still another tip shroud damper.

FIG. 12 is a perspective view of still another tip shroud damper 240. This damper may be substantially similar to the tip shroud damper 194 illustrated in FIG. 8, with the principal exception that the damper illustrated in FIG. 12 also includes a scalloped retention rail 242 comprising a plurality of fingers e.g., 244-248 extending from the retention rail.

Figure 13:
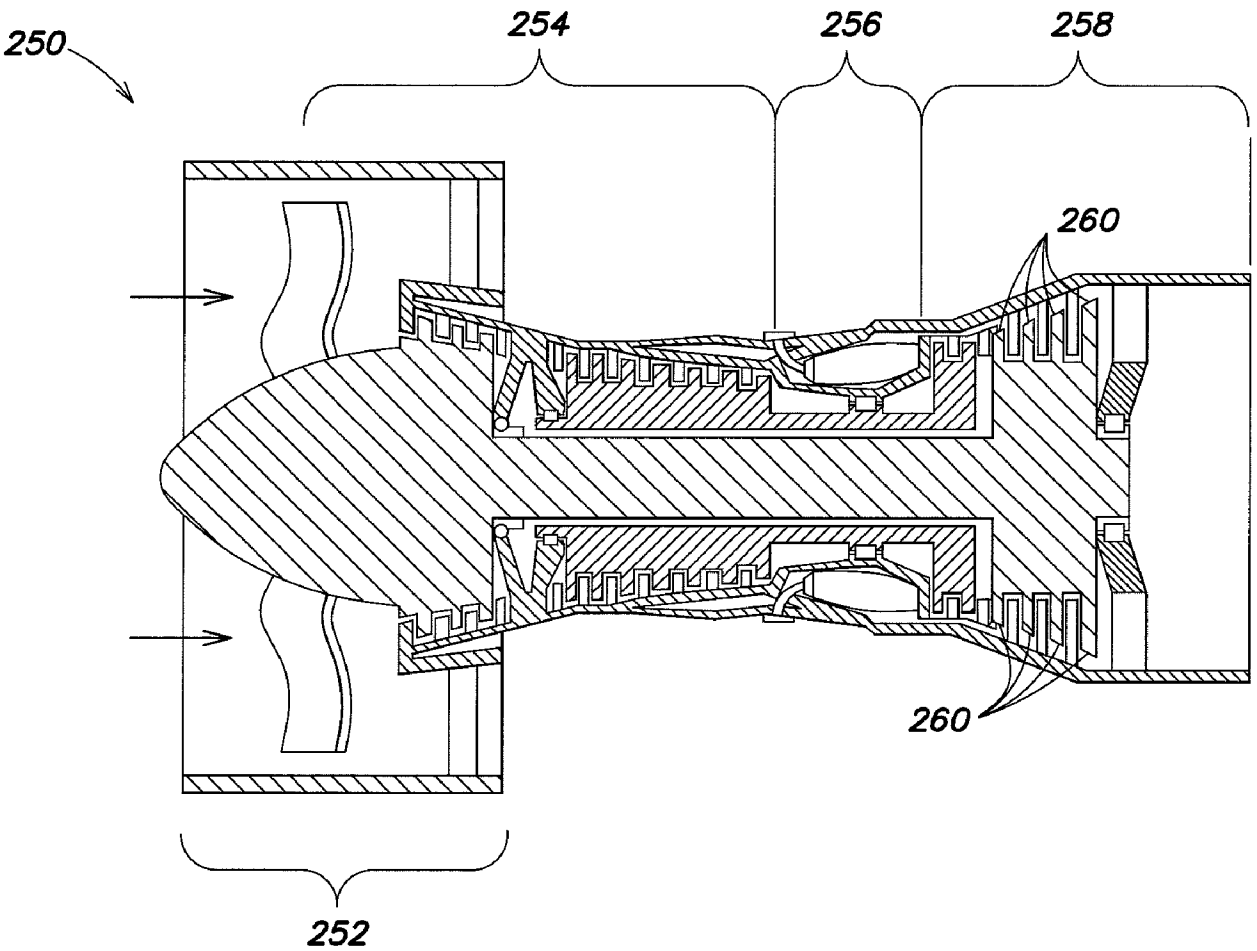
FIG. 13 is a cross sectional view of an axial flow, turbo fan gas turbine engine.

FIG. 13 is cross sectional view of an axial flow, turbo fan gas turbine engine 250. The engine includes a fan 252, a compressor 254, a combustion section 256 and a turbine 258. The turbine 258 comprises alternating rows of rotary airfoils or blades 260 and static airfoils or vanes. Each of the blades 260 may include a tip shroud separated from the tip shroud of an adjacent blade by a tip shroud damper.

Various thicknesses, lengths, weights and materials have been disclosed herein by way of example only, and are not intended to narrow the broad scope of the present invention. The tip shroud damper may be used for example in turbines for rocket engines (e.g., turbo pumps and oxygen turbo pumps), and gas turbine engines including industrial gas turbines, turbofans and turbojets.

Although various embodiments have been disclosed, it is contemplated that various other embodiments are within the scope of the invention. For example, the top surface of the retention rail may be flat, domed or even convex. In addition, the ribs of the retention rail may include sidewalls extending either perpendicularly or non-perpendicularly from the pillar.

The tip shroud damper reduces the vibratory responses of modes involving axial, radial and tangential shroud motion to prevent high cycle fatigue (HCF). In addition, the damper also assists in sealing the leakage path.

Although this invention has been shown and described with respect to the detailed embodiments thereof, it will be understood by those skilled in the art that various changes in form and detail thereof may be made without departing from the spirit and scope of the claimed invention.

What is claimed is:

1. A turbine, comprising:

a plurality of turbine blade tip shroud segments, each tip shroud segment having a outer wall and a inner wall; and a damper disposed between two of the plurality of turbine blade tip shroud segments, the damper having an I-beam configuration, where a radial gap extends between an upper portion of the I-beam section and the outer walls of the two of the plurality of tip shroud segments, and where a lower portion of the I-beam section sealingly abuts the inner wall of the I-beam section, and the damper is axially conforming to the geometry of the plurality of the tip shroud segments.

2. The turbine of claim 1, where the I-beam comprises a web that connects the upper portion and the lower portion, and the web comprises a plurality of through holes.

3. The turbine of claim 1, where the damper comprises a unibody damper.

4. A turbine disk, comprising:

a rotor;

a plurality of turbine blades, each comprising a root at a proximal end secured to the rotor, and a tip having a shroud at a distal end, where the shroud includes a inner diameter surface, an outer diameter surface and a segmented sidewall surface separating the inner and outer diameter surfaces; and a plurality of tip shroud dampers, where each of the plurality of dampers separate the shrouds of adjacent turbine blades, and each damper includes a retention rail that cooperates with the outer diameter surfaces to maintain a positional relationship of the tip shroud damper, an inner flange that engages the segmented sidewall surface, and a web that separates the retention rail and the inner flange.

5. The turbine disk of claim 4, where the segmented sidewall comprises a first segment substantially perpendicular to the outer diameter surface and extending from the outer diameter surface, and a curved second segment extending from the first segment.

6. The turbine disk of claim 5, where the inner flange comprises a first curved surface positioned adjacent to the curved second segment.

7. The turbine disk of claim 4, where the segmented sidewall separates the inner and outer diameter surfaces, and the sidewall includes a first segment substantially perpendicular to the outer diameter surface and extending from the outer diameter surface, and a second straight segment extending from the first segment to the inner diameter surface.

8. The turbine disk of claim 7, where the inner flange includes a flange surface substantially parallel to the second straight segment.

9. The turbine disk of claim 4, where the segmented sidewall comprises a first segment substantially perpendicular to the outer diameter surface, and a curved second segment extending from the first segment to the inner diameter surface.

10. The turbine disk of claim 9, where the inner flange includes a curved damper segment that extends from the web to an outer flange surface that is substantially flush with the inner diameter surfaces when the turbine disk rotates.

11. The turbine disk of claim 10, where the curved second segment and the curved damper segment are in face-to-face contact when the disk rotates.

12. The turbine disk of claim 4, where the segmented sidewall comprises a first segment substantially perpendicular to the outer diameter surface and extending from the outer diameter surface, a second segment substantially parallel to the outer diameter surface, and a third segment substantially parallel to the first segment and extending from the second segment to the inner diameter surface.

13. The turbine disk of claim 4, where a first one of the plurality of dampers comprises a unibody damper having an I-beam configuration, and a radial gap extends between the outer diameter surface and the retention rail of the first one of the plurality of dampers.

14. A gas turbine engine, comprising:

a fan;

a compressor;

a combustor;

a turbine, which comprises, a turbine disk;

a plurality of turbine blades, each comprising a root at a proximal end secured to the rotor, and a tip having a shroud at a distal end, where the shroud includes a inner diameter surface, an outer diameter surface and a segmented sidewall surface separating the inner and outer diameter surfaces; and a plurality of tip shroud dampers, where each of the plurality of dampers separate the shrouds of adjacent turbine blades, and each damper includes a retention rail that cooperates with the outer diameter surfaces to maintain a positional relationship of the tip shroud damper, an inner flange that engages the segmented sidewall surface, and a web that separates the retention rail and the inner flange.

15. The gas turbine engine of claim 14, where the segmented sidewall comprises a first segment substantially perpendicular to the outer diameter surface and extending from the outer diameter surface, and a curved second segment extending from the first segment.

16. The gas turbine engine of claim 14, where the inner flange comprises a first curved surface positioned adjacent to the curved second segment.

17. The gas turbine engine of claim 14, where the segmented sidewall separates the inner and outer diameter surfaces, and the sidewall includes a first segment substantially perpendicular to the outer diameter surface and extending from the outer diameter surface, and a second straight segment extending from the first segment to the inner diameter surface.

18. The gas turbine engine of claim 17, where the inner flange includes a flange surface substantially parallel to the second straight segment.

19. The gas turbine engine of claim 14, where the segmented sidewall comprises a first segment substantially perpendicular to the outer diameter surface, and a curved second segment extending from the first segment to the inner diameter surface.

20. The gas turbine engine of claim 14, where the retention rail comprises a scalloped surface extending substantially in an axial direction.

21. The gas turbine engine of claim 20, where the web comprises a through hole.

22. The gas turbine engine of claim 20, where the retention rail comprises first and section parallel scalloped edges.

23. The gas turbine engine of claim 14, where a first one of the plurality of dampers comprises a unibody damper having an I-beam configuration, and a radial gap extends between the outer diameter surface and the retention rail of the first one of the plurality of dampers.

* * * * *